United States Patent [19]

Bouldin et al.

[11] Patent Number: 4,610,596

[45] Date of Patent: Sep. 9, 1986

[54] APPARATUS FOR REMOVING COVER FROM BALED MATERIAL

[75] Inventors: Floyd E. Bouldin; E. Lloyd Bouldin; Thomas E. Cantrell; Floyd A. Pearsall, all of McMinnville, Tenn.

[73] Assignee: Bouldin & Lawson, Inc., McMinnville, Tenn.

[21] Appl. No.: 665,282

[22] Filed: Oct. 26, 1984

[51] Int. Cl.[4] ..... B65G 69/00

[52] U.S. Cl. ..... 414/412; 30/140

[58] Field of Search ..... 414/412; 30/140

[56] References Cited

U.S. PATENT DOCUMENTS 3,889,442 6/1975 Grahn et al. ..... 414/412 X 4,289,438 9/1981 Murer ..... 414/412

4,485,810 12/1984 Beard ..... 30/140 X

*Primary Examiner*—Frank E. Werner

*Attorney, Agent, or Firm*—Harrington A. Lackey

[57] ABSTRACT

An apparatus for removing a flexible cover from a bale of material, such as compressed peat moss, including a pusher member adapted to move the bale lengthwise against a plurality of knives adapted to cut across the front end of the cover as well as along the sides to slit the cover and separate it from the material. The pusher member is provided with spike devices for retaining the separated cover as the material is discharged from a discharge station, to remove the split separated cover to a cover removal station. In a preferred form of the invention, a stripper mechanism is included for stripping the split cover from the pusher member.

12 Claims, 5 Drawing Figures

APPARATUS FOR REMOVING COVER FROM BALED MATERIAL

BACKGROUND OF THE INVENTION

This invention relates to an apparatus for removing a cover from baled material, and more particularly to an apparatus for removing a flexible cover by cutting the cover to separate it from the enclosed baled material.

Heretofore, in the nursery and plant growing industry, peat moss and other soil material are packaged by compressing the material into a bale and enclosing the bale with a flexible plastic material for storage and transportation. The end user of the soil material, such as a nurseryman or commercial wholesaler or retailer of balled, potted or other plants having their roots covered with soil material, must separate the plastic cover from the soil material before the soil material can be used. Currently such plastic covers are manually removed by laborers with pocket knives, or other cutting instruments, slitting open numerous bale covers, separating the covers from the soil material, placing the soil material into some type of hopper, receptacle, or conveyor for further processing, and discarding the slit cover. One producer utilizes the services of two laborers continually, manually separating the plastic covers from baled peat moss, all day long, every day of the production process.

SUMMARY OF THE INVENTION

It is therefore an object of this invention to provide an automatic means for separating plastic covers from baled materials and particularly baled compressed peat moss and other soil material.

The apparatus includes an elongated platform upon which covered baled material is sequentially loaded and moved longitudinally through a plurality of movable knife blades. The blades initially engage the front or leading panel of the bale cover to form slits in the leading panel. The knife blades then move outward of the front panel and then rearwardly along the side and top walls of the bale cover, forming continuous slits in the cover as the bale moves toward a discharge station.

When the bale reaches the discharge station, it is discharged, completely separated from the cover. The separated cover is then carried rearwardly to an ejection position, where the bale cover is stripped and discarded.

The bale is moved from zthe loading station toward the discharge station by a pusher member which pushes the bale through the movable knives. The pusher member is provided with impaling spikes or prongs which engage and pierce the rear panel of the bale cover as the pusher members move toward the discharge station, so that the cover remains upon the spikes as the baled material separates from the cover at the discharge station.

A stripper mechanism may be provided at the rear of the apparatus for stripping the cover from the spikes of the pusher member.

The cutter blades are so positioned that they all engage and commence cutting the front panel so that the front panel is severed to provide a front opening for removal of the soil material through the front end of the bale cover at the discharge station. The longitudinal slits along the top and side walls of the bale cover further separate the cover from the soil material and permit expansion of the soil material within the cover to loosen the soil material for free discharge from the cover at the discharge station.

DESCRIPTION OF THE PREFERRED EMBODIMENTS

Figure 1:
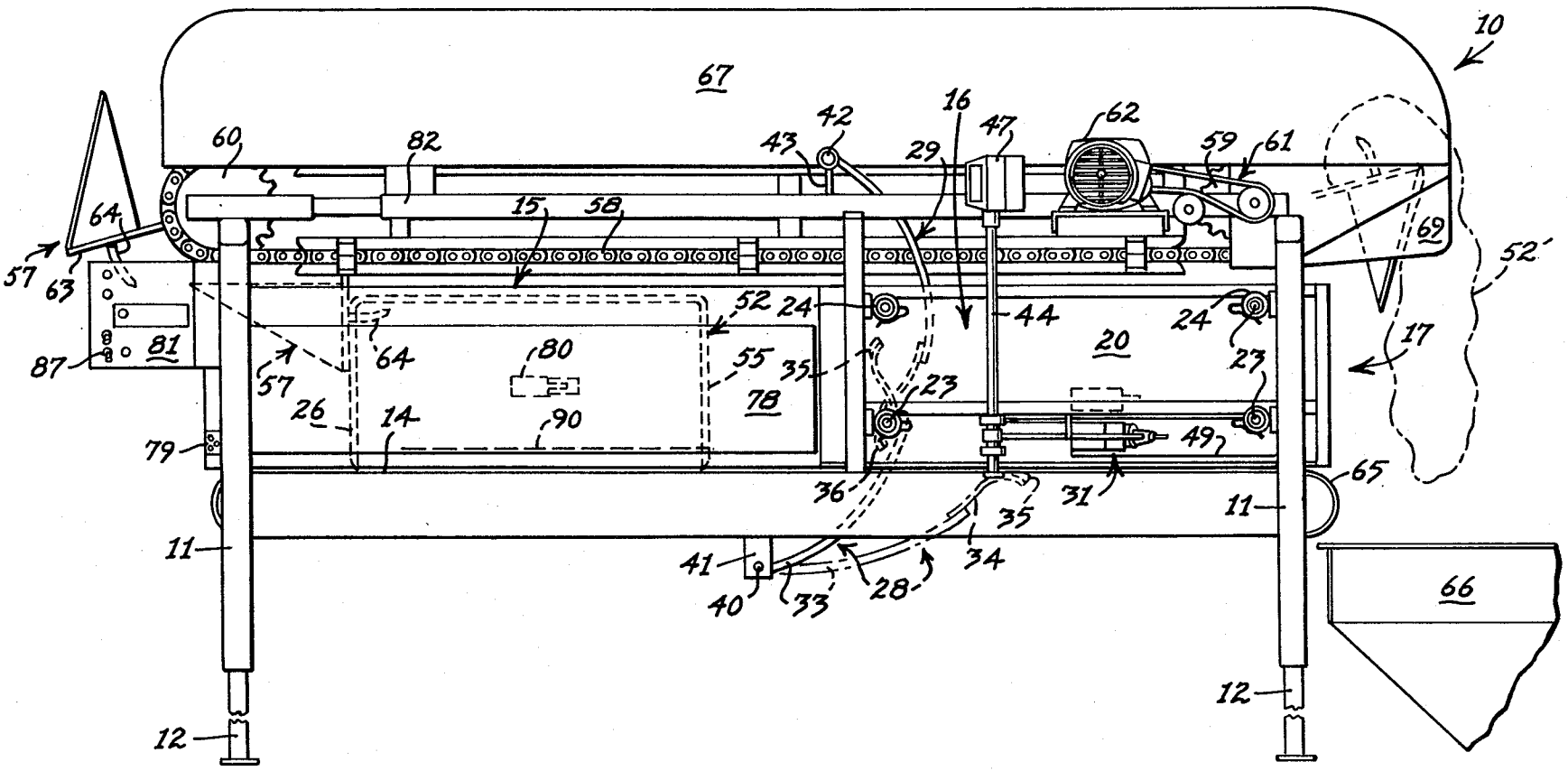
FIG. 1 is a side elevational view of the apparatus made in accordance with this invention, with the covered bale in its phantom loading position.
Figure 2:
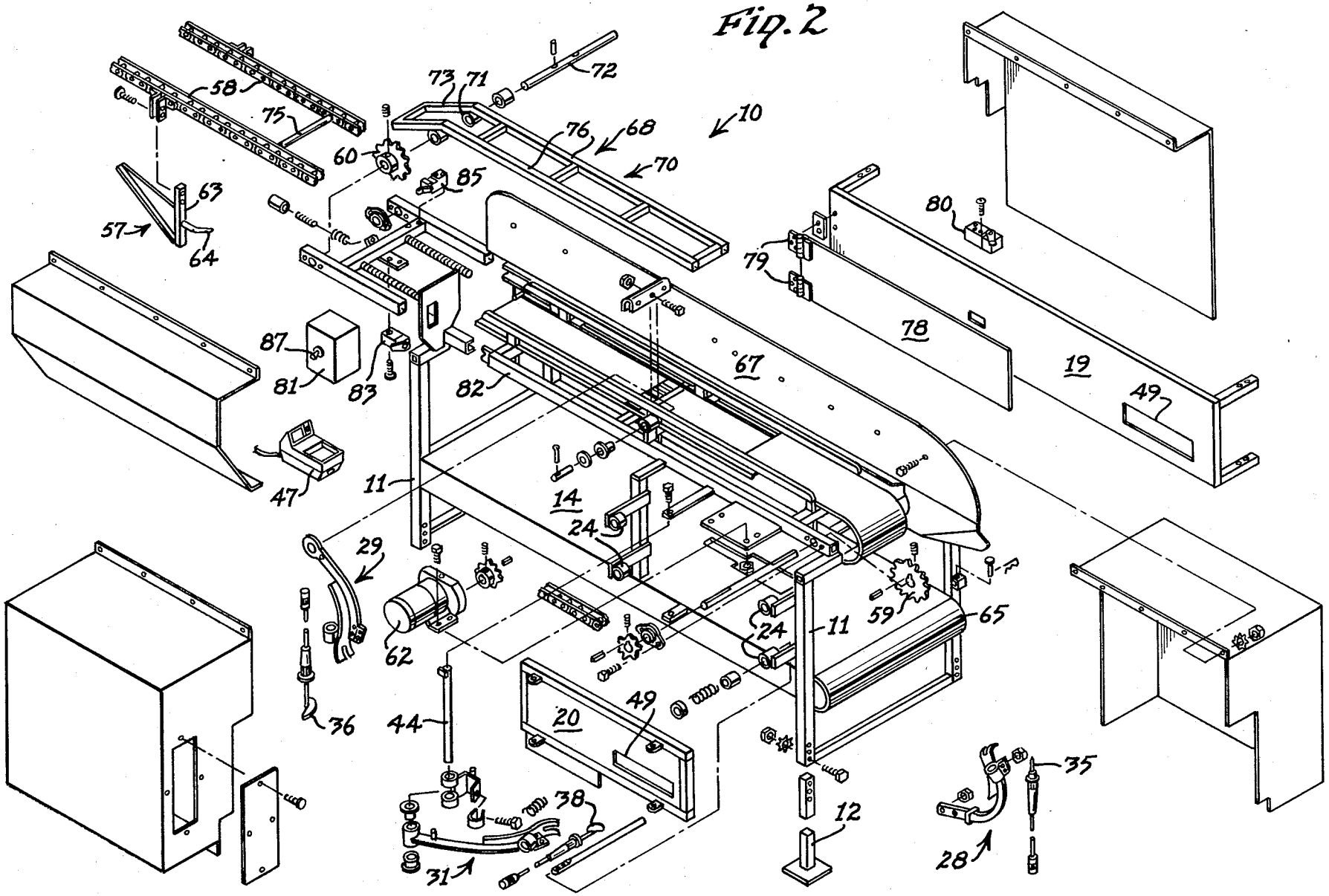
FIG. 2 is a front, top and near-side exploded, perspective view of the apparatus disclosed in FIG. 1.

Referring now to the drawings in more detail, and particularly to FIGS. 1 and 2, the apparatus 10 includes a frame 11 having telescoping legs 12 supporting an elongated horizontal platform 14. The rear portion of the platform 14 includes a loading station 15; the mid-portion includes a cutting station 16; and the front end portion includes a discharge station 17.

Figure 4:
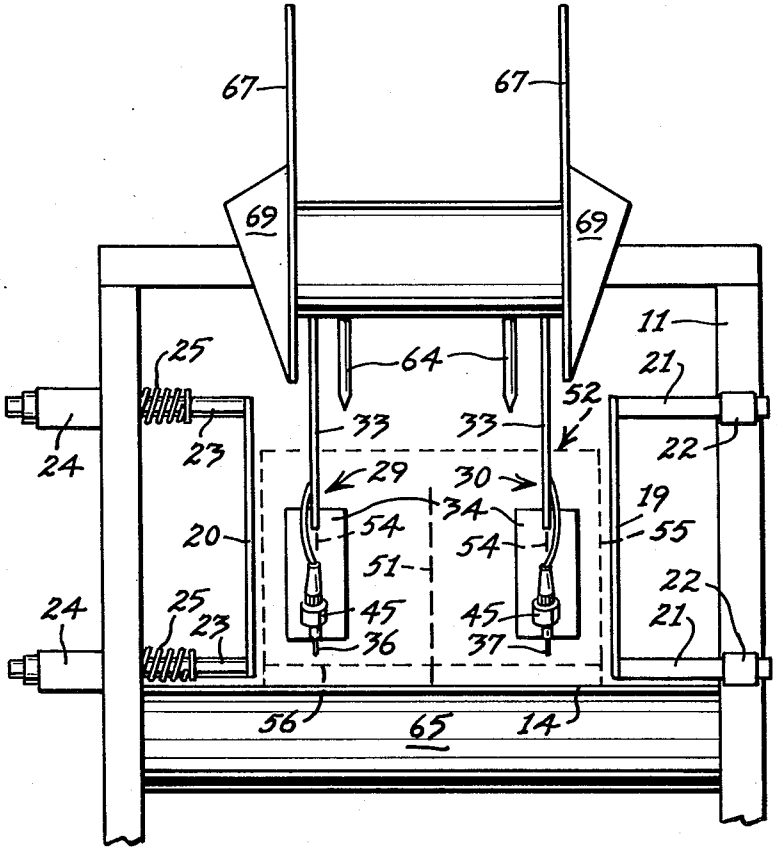
FIG. 4 is a front end elevational view of the apparatus disclosed in FIG. 1, with portions of the cutter mechanism omitted.

Mounted on the frame 11 along both sides of the cutting station 16 and extending to the discharge station 17, are a pair of opposed longitudinally extending, vertical chute walls 19 and 20, as best disclosed in FIG. 4. The chute wall 19 is mounted on the frame 11 for lateral adjustment in various fixed positions by means of adjustable rods 21 slideably secured in the collars 22.

The opposed chute wall 20 is mounted on lateral rods 23 telescopingly received in tubular brackets 24 fixed to the frame 11. A coil spring 25 connected between each respective rod 23 and bracket 24 biases chute wall 20 toward chute wall 19 to provide a laterally yieldable or resilient chute wall 20. Thus, the chute walls 19 and 20 and the corresponding portion of the platform 14 between the walls 19 and 20 provide an elongated chute through which the baled product 26 is yieldably constrained as it moves through the cutting station 16.

Figure 3:
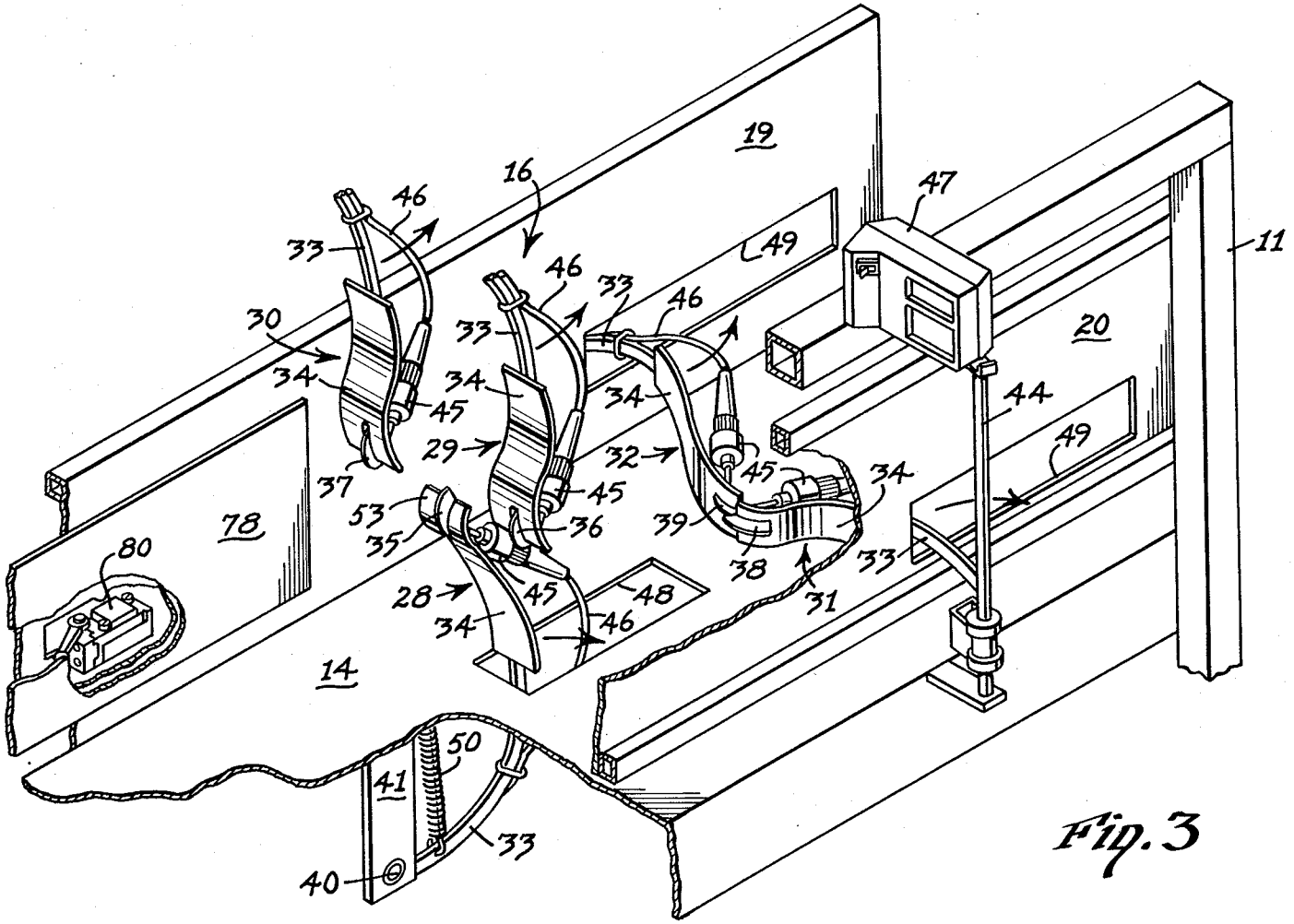
FIG. 3 is a top, near-side perspective view of the knife mechanism and chute, with portions broken away.

Mounted in the cutting station 16 are a plurality of knife members, including a front knife member 28, a pair of top knife members 29 and 30, and a pair of side knife members 31 and 32, as best disclosed in FIG. 3. Fach of the knife members 28–32 comprises an elongated arcuate arm 33 having a pivotal end and a free or operative end. Each operative end of an arm 33 is fixed to an elongated plate or shield 34, having a sinuous or S-shaped longitudinal cross-section and a width substantially greater than the width of the corresponding arm 33. At the remote end of each of the shields 34 is fixed a corresponding arcuate knife blade 35, 36, 37, 38 and 39, respectively (FIG. 3). The front blade 35 and the top blades 36 and 37 are disposed in parallel longitudinal vertical planes. The side blades 38 and 39 are disposed in substantially the same horizontal plane.

The pivotal end of the arm 33 of the front knife member 28 is journaled by pivot pin 40 to bracket 41 depending from the bottom of the platform 14, as best disclosed in FIGS. 1 and 3. The arms 33 of the top knife members 29 and 30 are journaled about shafts 42, fixed by bracket 43 to the top of the frame 11, as best illustrated in FIG. 1. Each of the arms 33 of the side knife members 31 and 32 have their pivotal ends journaled about vertical shafts 44, fixed to the respective sides of the frame 11 outside the respective chute walls 19 and 20.

Supported upon the front sides of the respective shields 34 are corresponding electrical heating elements 45 which are in electrically conductive contact with the corresponding knife blades 35–39. The heating elements 45 are connected by their corresponding electrical cords 46 to a source of electricity through heat controlled devices, such as the heat control device 47 disclosed in FIGS. 1 and 3.

It will be noted that the front knife member 28 extends through. an elongated opening 48 in the platform 14 for free vertical swinging movement about the journal pin 40. In a similar manner, the side cutting members 31 and 32 are adapted to freely swing in their respective horizontal planes through slots 49 in the respective chute walls 19 and 20. All of the knife members 28–32 are disclosed in their inoperative positions in FIG. 3. A coil spring 50 (FIG. 3) may be used to bias the front knife member 28 upward and forward to its extreme inoperative position.

In its initial inoperative position, the front knife blade 35 will encounter the front panel 55 of the bale cover 52, closer to the top of the bale cover 52 than the bottom, and substantially midway between the sides of the bale cover 52. As the front knife member 28 is pivoted forwardly by the forward moving bale 26, the heated knife blade 35 will continuously cut through the front panel 55 from the top center portion downwardly in a vertical direction to form the vertical slit 51 (FIG. 4). As the front knife member 28 is depressed through the opening 48, the knife blade 35 will continue its incision in the bale cover 52 around the lower front corner to make a short slit in the front portion of the bottom wall of the cover 52. As the bale 26 moves over the knife member 28, the curved cam portion 53 of the shield 34 will engage against the bottom wall of the bale cover 52 camming the knife blade 35 downward out of engagement with the bale cover to terminate the incision in the front portion of the bottom wall of the bale cover 52, to a short length of approximately 1–3 inches.

The top knife blades 36 and 37 are adapted to initially engage the lower portion of the front panel 55 of the bale cover 52 simultaneously on opposite sides of the front knife blade 35. As the bale 26 continues in its forward movement through the cutting station 16, the knife blades 36 and 37 will move upwardly to cut a pair of vertical incisions or slits 54 (FIG. 4) in the front panel of the cover 52 continuously to the top of the cover 52. The top blades 36 and 37 then cut around the top front edge of the bale cover 52 and continuously rearward along two longitudinal parallel lines in the top wall of the bale cover 52 for substantially the full length of the bale 26

It will be noted in FIG. 1 that the front knife member 28 commences its cutting action before any other knife member, and shortly before the commencement of the cutting by the knife members 36 and 37.

As the bale 26 continues forwardly through the cutting zone 16, the front panel 55 of the cover 52 engages the side knife blades 38 and 39, which are contiguous or overlapping in their initial position at the same low level relative to the height of the bale 26, as illustrated in FIGS. 1 and 3, and swing the side knife members 31 and 32 forward away from each other. The initial incisions of the side blades 38 and 39 in the front panel 55 will be coincidental. Subsequently, the knife blades 38 and 39 will travel laterally outward across the front panel 25 to cut a continuous incision or slit 56 (FIG. 4) in the lower portion of the front panel 55. Then the knife blades 38 and 39 will be pushed outward around the vertical front corners of the cover 52 and continue to travel in horizontal longitudinal lines to form longitudinal parallel slits 90 (FIG. 1) along the bottom portion of both of the side walls of the cover 52 for substantially the length of the bale 26.

The mechanism for moving the bale 26 longitudinally along the platform 14, from the loading station 15, through the cutting station 16, to the discharge station 17, includes one or more pusher members 57, each of which is carried by a pair of endless conveyor chain 58, which are trained about a pair of head sprockets 59 and a pair of tail sprockets 60 to travel in a pair of parallel vertical planes lengthwise of the frame 11. A pair of pusher members 57 and 57′ are disclosed in FIG. 1. The head sprockets 59 are driven through a sprocket-and-chain transmission 61 from an electrical motor 62 mounted on the frame 11, as best disclosed in FIG. 1, in order to move the lower run of the chain 58 longitudinally forward, while the upper run of the chain 58 is moved longitudinally rearwardly.

Each pusher member 57 includes a depending pusher bar 63 fixed to each chain 58 to project perpendicularly from the chain 58. Thus, each pusher bar 63 depends vertically from the lower run of the chain 58 to project down into the loading station 15. Projecting forward from each pusher bar 63 is a prong or spike 64 adapted to penetrate the flexible plastic cover 52 and impale itself into the baled material 26 as the pusher bars 63 move forwardly to carry the covered bale 26 forwardly throuoh the respective operating stations.

As the pusher member 57 continues to move the bale 26 through the cutting station 16, and after the cover 52 is completely slit by the five knife members 28–32, the rear panel of the cover member 52 remains uncut and impaled upon the prongs 64, even after the baled material is discharged over the front end 65 of the platform 14 at the discharge station 17, and into an appropriate hopper 66. As the pusher member 57′ (FIG. 1) reverses its direction about the head sprockets 59, the pusher merber 57′ continues to carry the empty and slit cover member 52′ rearwardly between the opposed guide walls 67 to the rear end of the apparatus 10, where the used and split cover member 52 may be removed manually or may be remove by a stripper mechanism 68 (FIGS. 2 and 5).

The front ends of the guide wall 67 may be provided with diverging flanges 69 for guiding the used cover member 52 upwardly between the guide walls 67.

The stripper mechanism 68 includes an elongated stripper arm member 70, illustrated as having a ladder construction, which is adapted to normally lie in a substantially horizontal plane (solid-line position, FIG. 5) between and below the upper runs of the conveyor chains 58. The stripper arm 70 has a bent portion secured to journal bearings 71 journaled about the tail sprocket shaft 72. The major forwardly extending portion of the stripper arm member 70 is substantially straight. The rearward and downward projecting arm portion comprises a trip arm member 73 which projects beyond the periphery of the tail sprockets 60.

Figure 5:
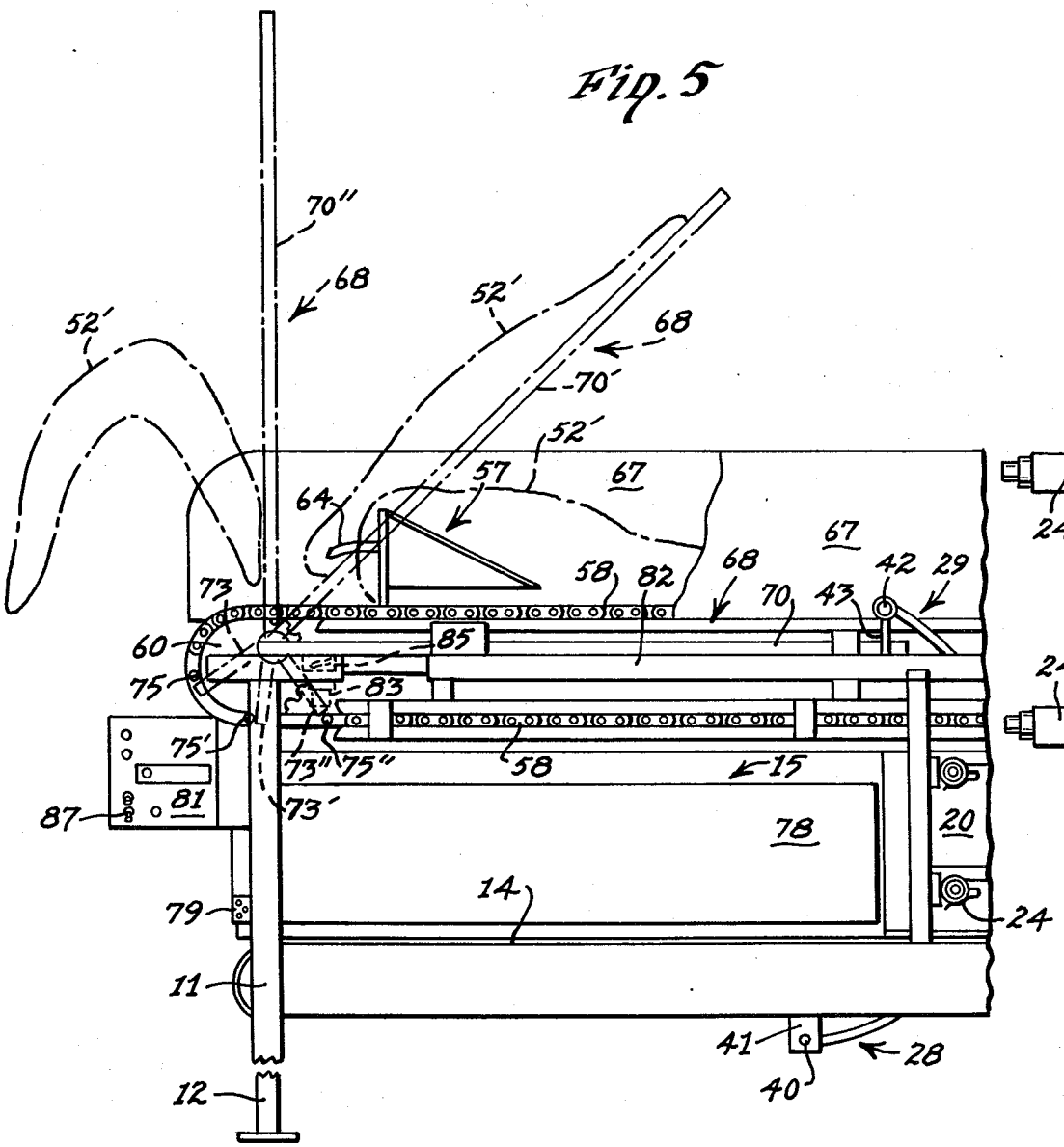
FIG. 5 is a fragmentary side elevational view of the rear portion of the apparatus, illustrating the operation of the stripper mechanism.

A transverse trip bar 75 is fixed between the pair of conveyor chains 58 in advance of the pusher member 57, as illustrated in FIG. 5. Thus, as the upper run of the chains 58 moves rearwardly with the stripper arm member 70 in its horizontal depressed position, the trip bar 75 moves over the stripper bar member 70, with the pusher member 57 carrying the used cover member 52' behind the trip bar 75. As the trip bar 75 is carried downwardly by the chains moving over the tail sprockets 60, the trip bar 75 engages the rear end portion of the trip arm member 73, as illustrated in FIG. 5. Continued downward movement of the trip bar 75 against the trip arm member 73 causes the stripper arm member 70 to rotate about the axis of the tail sprocket shaft 72 to its phantom position 70' to lift the used cover member 52'. As the stripper arm member 70 continues to rise to its phantom position 70'', its parallel arm merbers 76 move rearward past the rearward projecting spikes 64 on the pusher member 57 to strip the cover member 52' from the spikes 64 as illustrated in FIG. 5, and discharge the spent cover member 52' to a location behind the apparatus 10, such as a receptacle, not shown.

As best disclosed in FIGS. 1, 2 and 3, an elongated vertical starter or pressure plate 78 is supported by hinges 79 along its rear edge to the chute wall 19 in the loading station 15. Mounted in the chute wall 19 in the swinging path of the pressure plate 78 is a starter switch such as microswitch 80. Thus, when a bale 26 is introduced into the loading station 15 from the near side of the frame 11 and moved into its loading position in the loading station 15 against the pressure plate 78, the switch 80 is actuate to energize the control within the control box 81 to start the motor 62.

Mounted upon the conveyor frame 82, adjacent the tail sprocket 60 is a "stop" microswitch 83, located in the path of the trip bar 75 as it moves forward with the lower run of the chains 58. Thus, when the trip bar 75 engages the "stop" switch 83, the controls within the box 81 are actuated to stop the conveyor motor 62.

A safety switch 85 is preferably mounted upon the top of the conveyor frame 82 in vertical alignment beneath one of the stripper bars 76 for engagement by the corresponding stripper bar 76 in its horizontal inoperative position. The safety switch 85 is connected to the controls within the box 81 in such a manner that as long as the stripper bar 76 is engaging the safety switch 85, the apparatus 10 will continue to be automatically cycled to process the bales 26 and the bale covers 52. However, if for some reason, the stripper arm 70 remains in an upright position in which the stripper bar 76 is disengaged from the safety switch 85, the controls within the box 81 will prevent the motor 62 from operating, even if a bale 26 is in its loading position engaging and depressing the pressure plate 78 to actuate the starter switch 80.

The operation of the apparatus 10, will commence by the actuation of the main switch 87 on the control box 81 to initially heat the cutter blades 35–39. The controls within the box 81 are set so that even if a bale 26 is in its loading position depressing the starter plate 78, the apparatus will not operate until the cutter blades 35–39 have been heated to operating temperature.

Covered bales 26 of peat moss, or other material, may be fed to the platform 14 by a conveyor, not shown, which will introduce each bale 26, one-by-one, into the loading station 15 lengthwise of its longitudinal direction of movement, as illustrated in FIG. 1. When a bale 26 occupies the loading position, the pressure plate 78 is depressed to actuate the starter switch 80 to energize the conveyor motor 62 to move the chains 58 and the pusher members 57. A pusher member 57 will then engage the rear end of the bale 26, as illustrated in phantom in FIG. 1, causing the prongs 64 to penetrate the rear panel of the cover member 52 and commence moving the entire bale 26 with its enclosing cover 52 into the cutting station 16. In the cutting station 16 the bale cover 52 will be slit by all five knife blades 35–39, as previously described, while the bale 26 is moving between the chute walls 19 and 20. These knife members will create the previously described slits, all of which commence on the front panel 55, with the two top slits running the length of the cover member 52 in its top wall and the side slits 90 being cut continuously along the lower edge portions of the side wall of the cover member 52.

By the time the slit bale 26 enters the discharge station 17, the entire front end of the cover member 52 is opened to cause the peat moss, or other baled material, to fall into the hopper 66 over the front edge portion 65. The split cover member 52' permits the compressed material to expand slightly, both forwardly and laterally, to a minimum degree, permitting the compressed material to break up into chunks to facilitate discharge into the hopper 76. The split cover 52', still being impaled upon the prongs 64 is carried upwardly and rearwardly about the head sprockets 59 with the empty cover being moved toward the rear of the apparatus 10.

If the stripper arm member 70 is in its lower inoperative position, the trip bar 75 moves over the stripper bar member 70 until it engages the trip arm member 73, at which time the pusher member 57 is approaching the tail sprockets 60, dragging the split cover 52' over the depressed stripper arm member 70. After the trip bar 75 engages the trip arm member 73, the stripper bar member 70 is elevated to swing about the axis of the tail sprocket shaft 72, and moving faster rearwardly than the pusher member 70, moves between and past the prongs 64 to strip the cover 52' from the prongs 64 and discharge the split cover 52' over the rear end of the apparatus 10 upon the ground, or into a receptacle, not shown.

The trip bar 75, having moved past the tail sprockets 60 and again in a forward direction, engages the stop switch 83 to operate the controls in the box 81, to stop the drive of the conveyor motor 62, until the next bale engages the pressure plate 78 in the loading station 15.

It has been found that if the front knife member 28 is permitted to continue cutting a longitudinal slit along the center of the bottom panel or wall of the cover 52, that the side portions of the split cover 52 tend to move laterally outward and become bunched up between the bales 26 and the chute walls 19 and 20, creating jamming of the apparatus 10. Accordingly, the front knife member 28 is so designed that it cuts only the front panel 55 and terminates its cut in only a small portion of the front portion of the bottom wall of the cover 52. The weight of the baled material 26 upon the bottom wall of the cover 52, holds the bottom wall of the cover 52 upon the platform 14 beneath the baled material 26 until the baled material 26 and the bottom wall of the slit cover 52' are discharged from the front end 65 of the apparatus 10.

The multiple incisions formed in the front panel 55 by the five knife blades 35–39, divide the front end portion of the cover 52 sufficiently that no substantial pockets remain in the corners of the front portion of the bale cover 52. Accordingly, substantially, all of the baled material 26 is discharged from the bale cover 52 into the hopper 66, as the pusher members 57 carry the split cover 52' upward and over the head sprockets 59.

The side knife members 31 and 32 are located at a very low elevation in the frame 11 so their respective knife blades 38 and 39 will cut closely adjacent the bottom edge of the side walls of the cover 52 to substantially eliminate any lower corner pockets in the front panel 55. Accordingly, practically all of the compressed baled material 26 will drop from the lower front edge of the front panel 55 as the cover 52 passes over the curved front edge wall 65.

It is therefore apparent that a novel automatic apparatus 10 for cutting and removing a flexible bale cover 52 from compressed baled material has been developed. Moreover an automatic means for moving the empty bale cover 52' away from the baled material at the discharge station 17 and for extracting the bale cover 52'from the apparatus 10 at a remote location, has been devised.

What is claimed is:

1. An apparatus for removing a flexible cover from a bale of material comprising:

(a) a loading station adapted to receive an elongated bale of material having a longitudinal axis, enclosed by a flexible cover having a front end, a rear end, top, bottom and opposed side walls, in a loading position;

(b) knife means spaced longitudinally of said loading station and in front of said loading position and adapted to cut through the flexible cover, (c) a discharge station spaced in front of said knife means, (d) pusher means for moving the covered bale of material, (e) means for moving said pusher means longitudinally to engage the rear end of the bale in said loading station and to push the baled material through said knife means toward said discharge station, to cause said knife means to cut a slit in said front end and longitudinally through at least one of said walls, whereby after the bale cover is slit, the baled material is discharged from said slit bale cover at said discharge station, (f) means for returning said pusher means to said loading station, (g) said pusher means comprising prong means for impaling the cover on the baled material and for carrying the slit cover separated from the baled material from said discharge station back toward said loading station.

2. The invention according to claim 1 further comprising cover stripper means for removing the separated slit cover from said prong means.

3. The invention according to claim 2 in which said pusher means comprises a pusher head and means for supporting said pusher head for longitudinal reciprocable movement between said loading station and said discharge station, said prong means comprising at least one prong projecting forward from said pusher head, said stripper means comprising means for stripping a slit separated bale cover from said prongs as said pusher head returns to said loading station.

4. The invention according to claim 3 in which said means for moving said pusher head comprises an endless chain having upper and lower runs; said lower run moving longitudinally from said loading station toward said discharge station, said pusher head being adapted to carry said slit separated cover from said lower run to said upper run at said discharge station to carry the slit cover rearwardly, said stripper means comprising a stripper arm and means pivotally mounting said stripper arm below the upper run of said chain for swinging movement upward and rearward, trip means on said chain for engaging said stripper arm to swing said stripper arm upward in front of said pusher head to cause said stripper arm to engage a slit cover impaled on said prongs and to remove said cover from said prongs.

5. The invention according to claim 4 in which said trip means comprises a transverse trip bar carried by said endless chain, said stripper arm having a trip arm projecting rearwardly from said pivotal mounting means, whereby said trip bar engages said trip arm as said trip bar reverses its direction from rearward to forward, and cause said stripper bar to swing upward and rearward.

6. The invention according to claim 1 in which said knife means comprises a pair of opposed side cutter blades, means mounting said side cutter blades to move from an adjacent starting position in front of the bale cover in said loading position, said blades being adapted to travel transversely away from each other as they engage the front end of the relatively longitudinally moving bale cover, and then rearwardly along the opposed side walls of the bale cover to form a continuous substantially horizontal slit along the front end of the bale cover and both side walls of the bale cover.

7. The invention according to claim 6 further comprising a vertically movable knife member adapted to cut a vertical slit in the front end of the bale cover as said baled material moves relatively towards said knife means to create a vertical slit extending substantially the full height of the front end of the bale cover and intersecting said horizontal slit.

8. The invention according to claim 7 in which said means mounting said side cutter blades supports said side cutter blades for movement along the lower portion of said front end and said side walls closely adjacent said bottom wall of the bale cover.

9. The invention according to claim 8 further comprising a pair of top cutter blades mounted in front of a bale in said loading position and being spaced apart transversely a distance slightly less than the width of the bale to be cut, and mounting means for said top cutter blades to permit said blades to cut a pair of spaced vertical slits in the front end of the bale cover and continuous longitudinal slits along the top wall of the bale cover.

10. The invention according to claim 9 in which said side cutter blades and said top cutter blades are adapted to cut continuous longitudinal slits substantially the full length of the side walls and the top wall, respectively.

11. The invention according to claim 9 in which said means mounting said knife blades comprise pivotal arm members, and means pivotally mounting said arm members for swinging movement, said arm members having free ends, each free end supporting a corresponding knife blade, said side cutter blades being adapted to swing in horizontal transverse arcs, and said vertical cutter blade and said top cutter blades being adapted to swing in parallel longitudinal vertical planes.

12. The invention according to claim 1 furhter comprising an elongated chute having a bottom wall and a pair of side walls extending longitudinally between said loading station and said discharge station, said knife means being mounted within said chute, the cross-section of said chute being substantially the same as the cross-section of the bale moving through said chute.

* * * * *